US007821474B2

(12) United States Patent
Marcu et al.

(10) Patent No.: US 7,821,474 B2
(45) Date of Patent: Oct. 26, 2010

(54) RENDERING LUMINANCE LEVELS OF A HIGH DYNAMIC RANGE DISPLAY

(75) Inventors: Gabriel G. Marcu, San Jose, CA (US); Wei Chen, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 1042 days.

(21) Appl. No.: 11/549,544

(22) Filed: Oct. 13, 2006

(65) Prior Publication Data

US 2008/0088647 A1 Apr. 17, 2008

(51) Int. Cl.
*G09G 5/00* (2006.01)
*G09G 3/36* (2006.01)

(52) U.S. Cl. ..... 345/4; 345/87; 345/88

(58) Field of Classification Search ..... 345/690
See application file for complete search history.

(56) References Cited

U.S. PATENT DOCUMENTS 4,917,465 A * 4/1990 Conner et al. ..... 349/5
4,952,036 A * 8/1990 Gulick et al. ..... 349/82
5,124,818 A * 6/1992 Conner et al. ..... 349/75
5,298,892 A * 3/1994 Shapiro et al. ..... 345/88
5,416,890 A * 5/1995 Beretta ..... 345/590
5,831,625 A * 11/1998 Rich et al. ..... 345/587
5,978,142 A 11/1999 Blackham et al.
6,043,797 A * 3/2000 Clifton et al. ..... 345/589
6,300,931 B1 * 10/2001 Someya et al. ..... 345/102
6,414,664 B1 * 7/2002 Conover et al. ..... 345/89
6,891,672 B2 5/2005 Whitehead et al.
2002/0021292 A1 * 2/2002 Sakashita ..... 345/204
2005/0017989 A1 * 1/2005 Huang ..... 345/690
2005/0157366 A1 * 7/2005 Asahi et al. ..... 359/238
2005/0162737 A1 7/2005 Whitehead et al.
2006/0055835 A1 * 3/2006 Nitta et al. ..... 349/7

FOREIGN PATENT DOCUMENTS

WO WO 02/03687 1/2002

OTHER PUBLICATIONS

Date et al, "Luminance addition of a stack of multidomain liquid-crystal displays and capability for depth-fused three-dimensional display application", Feb. 2005, Applied Optics, vol. 44, No. 6, pp. 898-905.*

Olson, Ryan, "*Going Deep, PureDepth monitors deliver. 3D you have to see to believe.* ", Red Herring, Dec. 4, 2006. (1 page).

*3D Projection System is now available.* [online] Neurok Optics, LLC [retrieved on Mar. 13, 2007]. Retrieved from the Internet: <URL: http://www.neurokoptics.com/products/>. (4 pages).

(Continued)

*Primary Examiner*—Richard Hjerpe
*Assistant Examiner*—Dorothy Webb
(74) *Attorney, Agent, or Firm*—Fish & Richardson P.C.

(57) ABSTRACT

Systems, methods, and computer software for use in driving a high dynamic range display involve generating table entries of luminance levels for a high dynamic range display and ordering the table according to the luminance levels. If the table includes multiple entries with equal values for a particular luminance level, one of the multiple entries is designated as corresponding to the luminance level.

27 Claims, 3 Drawing Sheets

OTHER PUBLICATIONS

BrightSide Display Technology. [online] BrightSide Technologies, 2005 [retrieved on Mar. 13, 2007]. Retrieved from the Internet: <URL: http://www.brightsidetech.com/bstech.php>. (1 page).

High Dynamic-Range Display [online]. Siggraph, 2004 [retrieved on Mar. 13, 2007]. Retrieved from the Internet:<http://www.siggraph.org/s2004/conference/etech/high.php?=conference>. (2 pages).

"*Software Development for Multi-Layer Displays*", [online] PureDepth Ltd. Whitepaper, 2005 [retrieved on May 14, 2007]. Retrieved from the Internet: <URL: http://www.puredepth.com/Docs_Downloads/MLD%20Software%20Development%20White%20Paper%20Overview%20-%20Feb%202007.pdf>. (8 pages).

Wong, B.L. William; Joyekurun, Ronish; Mansour, Hoda; Amaldi, Paola; Nees, Anna; Villanueva, Rochelle; "*Depth, Layering and Transparency: Developing design techniques*", [online] 2005, [retrieved on May 14, 2007]. Retrieved from Internet: <URL: http://www.puredepth.com/Docs_Downloads/Wong_et_al_CHINZ_2005.pdf>. (8 pages).

Kooi, F.L. Dr., "*The case for transparent death displays*." [online] TNO Human Factors, 2001 [retrieved on May 14, 2007]. Retrieved from Internet: <URL: http://www.puredepth.com/Docs_Downloads/TNO_transparent_displays.pdf>. (8 pages).

Sharff, Lauren F.V., "*Serial Visual Searches Processed Efficiently Across Multiple Depth Planes*", [online], Stephen F. Austin State University, 2000 [retrieved on May 14, 2007]. Retrieved from Internet: <URL: http://hubel.sfasu.edu/research/arvo2000.html>. (7 pages).

"*BrightSide DR37-P—The Best TV You Can't Buy . . . Yet*" [*online*] *Popsci.com, 2006* [*retrieved on Mar. 13, 2007*]. *Retrieved from Internet: <URL: http://www.popsci.com/popsci/flat/brown/2006/product*_64.html>. (2 pages).

* cited by examiner

RENDERING LUMINANCE LEVELS OF A HIGH DYNAMIC RANGE DISPLAY

FIELD OF DISCLOSURE

This application relates to high dynamic range displays.

BACKGROUND

Color display devices, such as computer monitors and television sets, typically include thousands of individual pixels. A pixel is a discrete picture element that, for example, can generate a range of colors at a particular location on a display screen. Pixels are typically arranged in an array of columns and rows. Collectively, the pixels can be used to form an image. For example, each pixel corresponds to a dot, and a combination of thousands of dots having various different colors and intensities produces a viewable image on a display screen.

High dynamic range displays feature very high contrast and brightness characteristics that simulate the human vision experience of real life scenes through the ability to produce pixels that have a broader available intensity range than does a conventional display. High dynamic range displays offer a unique user experience especially in photography and cinema applications.

SUMMARY

A table for driving a high dynamic range display can be generated to produce a mapping between overall luminance levels and corresponding transmission levels of multiple panels used for the high dynamic range display. This mapping can be further mapped to an output target function to incorporate any desired type of tone mapping correction, such as gamma correction In one general aspect, entries in a table of luminance levels for a high dynamic range display are generated and the table is ordered by the luminance levels. If the table includes multiple entries with equal values for a luminance level, one of the multiple entries is designated as correspond to the luminance level.

Implementations can include one or more of the following features. After designating one of the multiple entries, the other multiple entries can be deleted. The table can be indexed monotonically according to an index 0 to M, where M is a number of rows of entries in the table and corresponds to M possible luminance levels of the display. The display can include first and second panels, where the first panel has Na possible transmission levels and the second panel has Nb possible transmission levels. Generating the entries of the table can include measuring the luminance level of the display resulting from each combination of the transmission levels or computing the luminance level of the display from each combination of the transmission levels using a luminance transfer function.

In addition, the luminance transfer function can be $G(i,j)=Y(0)*Ta(i)*Tb(j)*C$, where $Y(0)$ is a luminance level of a backlight of the display; C is a constant; $G(i,j)$ is the luminance level corresponding to transmission levels Ta and Tb of the first and second panels, respectively; Ta is denoted from $Ta(0)$ to $Ta(Na-1)$ and indexed $Ta(i)$, wherein $0 \leqq i \leqq Na-1$; and Tb is denoted from $Tb(0)$ to $Tb(Nb-1)$ and indexed $T(j)$, wherein $0 \leqq j \leqq Nb-1$. The display can be rendered to a luminance level according to a corresponding entry in the table. A tone mapping correction between the ordered table and an output target function can be generated for the high dynamic range display. The tone mapping correction can be a gamma correction.

In another general aspect, a display can include first and second panels. The first panel can include Na possible transmission levels and the second panel can include Nb possible transmission levels. A driver can be coupled to the first and second panels to drive the first and second panels to respective transmission levels.

Implementations can include one or more of the following features. Values of the transmission levels can be stored as retrievable entries in a table on one or more machine-readable media. The driver can include a luminance transfer function. The luminance transfer function can be mapped to a gamma correction function.

In another general aspect, a transmissivity level for each pixel location of multiple pixel locations on two or more display panels can be controlled. Each display panel can operate to realize a transmissivity level for each pixel location independently of a corresponding pixel location on the other display panel(s). A set of corresponding pixel locations on the two or more display panels can operate to produce a combined luminance level for a pixel. A table of luminance level entries can be stored, and each luminance level entry can identify a particular transmissivity level for each of the two or more display panels usable to produce a particular luminance.

Implementations can include one or more of the following features. The table of luminance levels entries can be automatically generated. The table can be ordered by the luminance levels and one of multiple entries can be designated to correspond to a specific luminance level in cases where the table includes multiple entries with equal values for the specific luminance level.

DETAILED DESCRIPTION

Figure 1:
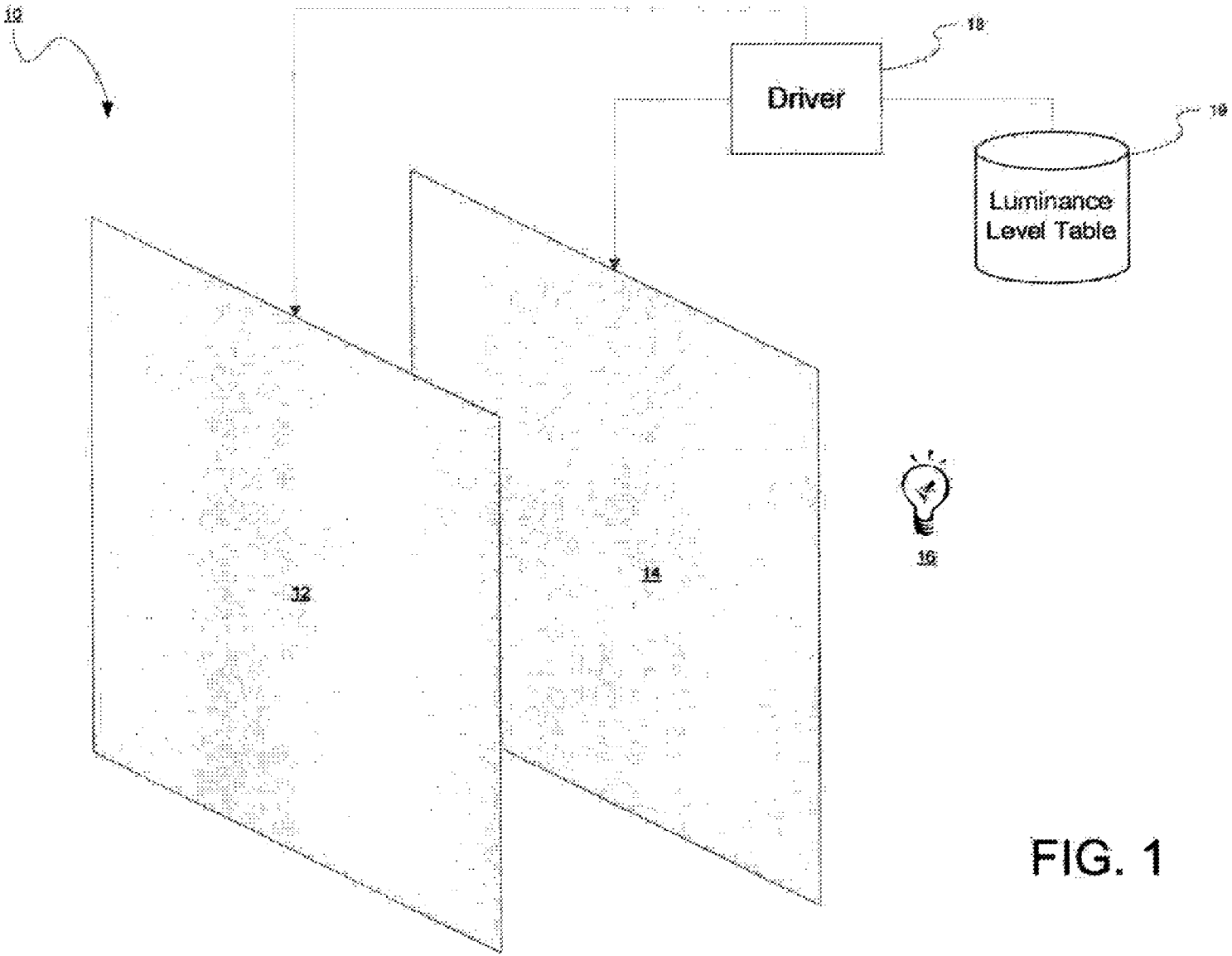
FIG. 1 shows a high dynamic range display.

As shown in FIG. 1, HDR display 10 includes first and second panels 12 and 14 and backlight 16. The first and second panels 12 and 14 are each, for example, liquid crystal display (LCD) panels with Na and Nb possible transmission levels, respectively. The panels 12 and 14 can be color panels, or alternatively, monochrome panels. The backlight can be any backlight, for example, a fluorescent backlight or an array of light emitting diodes.

At any given luminance of the backlight 16, HDR display 10 features an extremely high contrast ratio due to the ranges of possible transmission levels at the individual pixel level of the first and second panels 12 and 14. Rendering the luminance of individual pixels of the HDR display 10 is a function of driving the transmissivity of individual pixels of the first and second panels 12 and 14 to desired levels. For example, if the first and second panels 12 and 14 have the same number of pixels, and each pixel location on the first panel 12 corresponds (at least approximately) to a pixel location on the second panel 14, the luminance of each pixel is a function of the combined transmissivity of the first and second panels 12 at the pixel location. In some implementations, a diffuser can be used between the first and second panels 12 and 14 to mitigate any moiré effect that may result from even a small spacing between the panels 12 and 14.

A driver 18 controls the transmissivity of each pixel location in each panel 12 and 14 by, for example, sending signals that control modulation levels of the individual pixel locations on each panel 12 and 14. The driver 18 can coordinate the transmissivity of the corresponding pixel locations on the panels 12 and 14 to produce a particular luminance level for the pixel at that pixel location. Because the luminance level of a given pixel can be driven independently from another pixel, each at dynamic contrasts, the HDR display 10 as a whole simulates the human vision experience of real life scenes, particularly when the panels 12 and 14 are combined with a backlight 16 that is capable of producing high luminance white light. In some implementations, a brighter backlight is desirable to compensate for transmissivity losses caused by light passing through both the first and second panels 12 and 14.

For purposes of rendering luminance levels at the individual pixel level, it is desirable to have a predefined technique for selecting an appropriate combination of transmissivity levels for the pixel locations in the first and second panels 12 and 14 for each desired luminance. The selected combinations can be stored as a function or table in a luminance level database 19. The driver 18 can then access the data stored in the database 19 to determine the appropriate combination of transmissivity levels for the pixel locations in the first and second panels 12 and 14 to achieve a desired luminance for each pixel of the overall HDR display 10.

Figure 2:
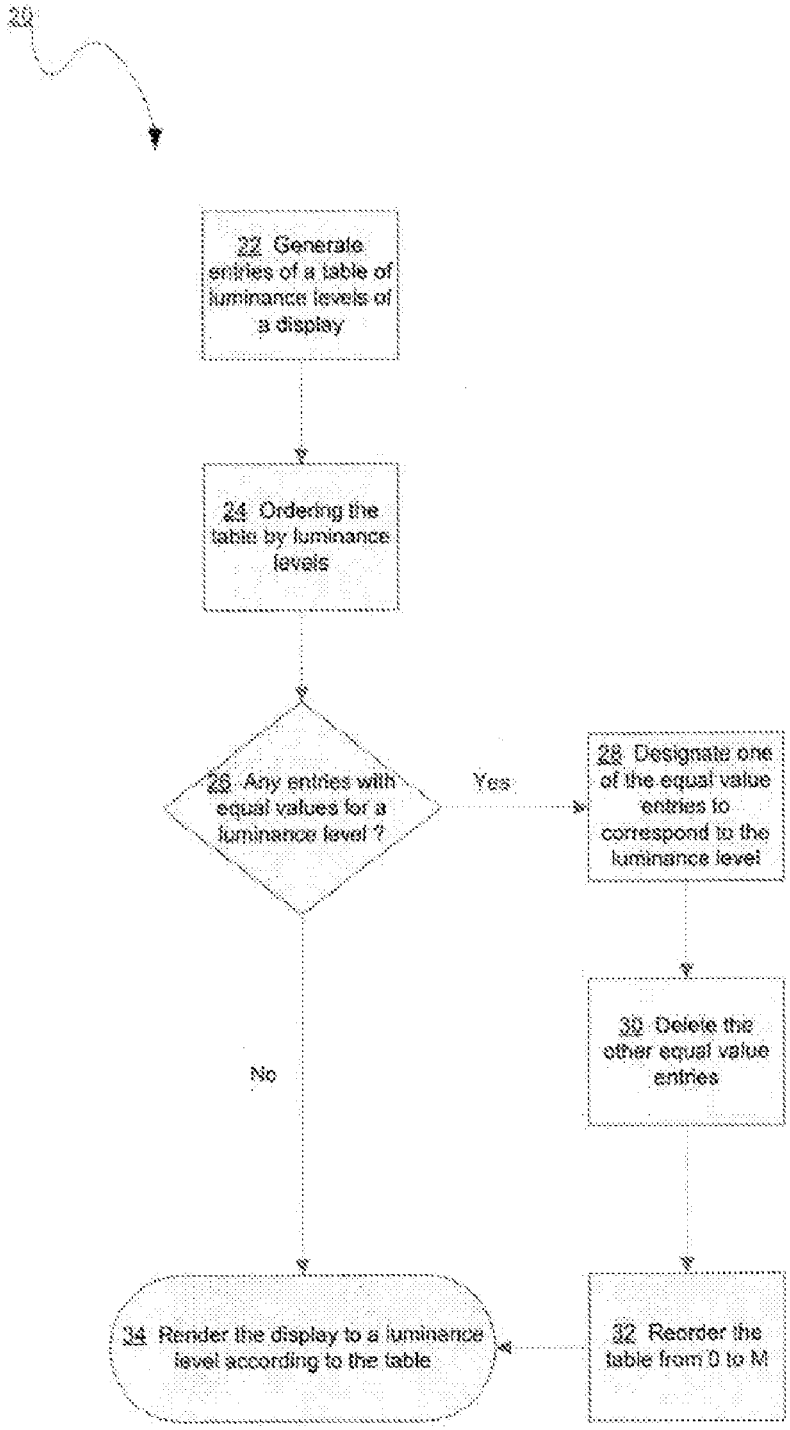
FIG. 2 shows a process to render the luminance level of a high dynamic range display.

Referring to FIG. 2, process 20 renders the luminance levels of a high dynamic range (HDR) display. With regard to the Na and Nb possible transmission levels of the first and second panel, respectively, process 20 generates (22) a luminance transfer function and a driving table for the HDR display. One example of a luminance transfer function is:

$$G=Y(0)\times Ta(i)\times Tb(j)\times C,$$

wherein Y(0) is the luminance of a backlight of the HDR display, Ta(i) and Tb(j) are the transmission levels of the first and second panels, respectively, and C is a constant. The luminance level of the HDR display is therefore expressed as a function of the transmission levels of the first and second panels. That is, G is the luminance level of a specific color channel (for example, but not limited to, red, green, or blue; monochrome; or the channels of a YUV display) of the HDR display that results from overlapping the first panel with transmission level Ta(i) over the second panel with transmission level Tb(j). While this application discusses the luminance transfer function with respect to one color channel of the HDR display, it is appreciated that the same luminance transfer function can be applied to the luminance levels of other color channels. Although a typical implementation of a color display may involve three color channels other numbers of color channels can be used (e.g., four or more).

Assuming that the first panel has Na possible transmission levels, the possible transmission levels of the first panel are denoted Ta(0), Ta(1), . . . , Ta(Na−1) and indexed Ta(i), wherein 0<i<Na−1. Similarly, if the second panel has Nb possible transmission levels, the possible transmission levels of the second panel are denoted Tb(0), Tb(1), . . . , Tb(Nb−1) and indexed Tb(j), wherein 0<j<Nb−1. Accordingly, the HDR display features at most N=Na×Nb distinct luminance levels (some of which could be duplicates, as will be described below). Process 20 generates (22) a table of luminance levels for the HDR display as follows in Table 1:

TABLE 1

| Index | Transmission level of first panel, Ta(i) | Transmission level of second panel, Tb(j) | Luminance level of HDR display G(i, j) |
|---|---|---|---|
| 0 | 0 | 0 | G(0, 0) |
| 1 | 1 | 0 | G(1, 0) |
| . . . | . . . | . . . | . . . |
| Na-1 | Na-1 | 0 | G(Na-1, 0) |
| Na | 0 | 1 | G(0, 1) |
| . . . | . . . | . . . | . . . |
| 2(Na-1) | Na-1 | 1 | G(Na-1, 1) |
| 2Na-1 | 0 | 2 | G(0, 2) |
| . . . | . . . | . . . | . . . |
| N | Na-1 | Nb-1 | G(Na-1, Nb-1) |

The range G(0,0) through G(Na−1, Nb−1) is the dynamic range of luminance of the HDR display, and accordingly, the maximum possible contrast ratio of the HDR display is N:1. For example, if the two panels each have 100 possible transmission levels, then N=100×100 or 10,000 and the maximum possible contrast ratio of the HDR display is 10,000:1.

In some implementations, process 20 generates (22) the entries of the table from measuring the luminance level G(i,j) of the display resulting from each combination of the transmission levels Ta(i) and Tb(j). In other implementations, process 20 generates (12) the entries of the table from computing the luminance level G(i,j) with a luminance transfer function using each combination of the transmission levels Ta(i) and Tb(j).

After process 20 generates (22) the entries of the table of luminance levels, process 20 orders (24) the entries of the table according to the luminance levels G(0,0) through G(Na−1,Nb−1). If there are multiple entries which correspond to transmission level pairs that conduct to a single luminance value (26), the process designates (28) one entry in the table to correspond to the particular luminance level, and deletes (30) the other entries. That is, given multiple entries with equal levels for a particular luminance G(i,j), process 20 can render the HDR display to luminance level G(i,j) by driving the first and second panels to the transmission levels Ta(i) and T(j) of any of the multiple entries. As an example, assuming Ta(0) and Tb(Na−1) drives luminance G(0, Na−1) with a level equal to Ta(46) and Tb(55) driving luminance G(1,0), and the luminance level is the same, G(1,0)=G(0,Na−1), then process 20 can designate the former combination to render the luminance level while deleting the latter combination.

Figure 3:
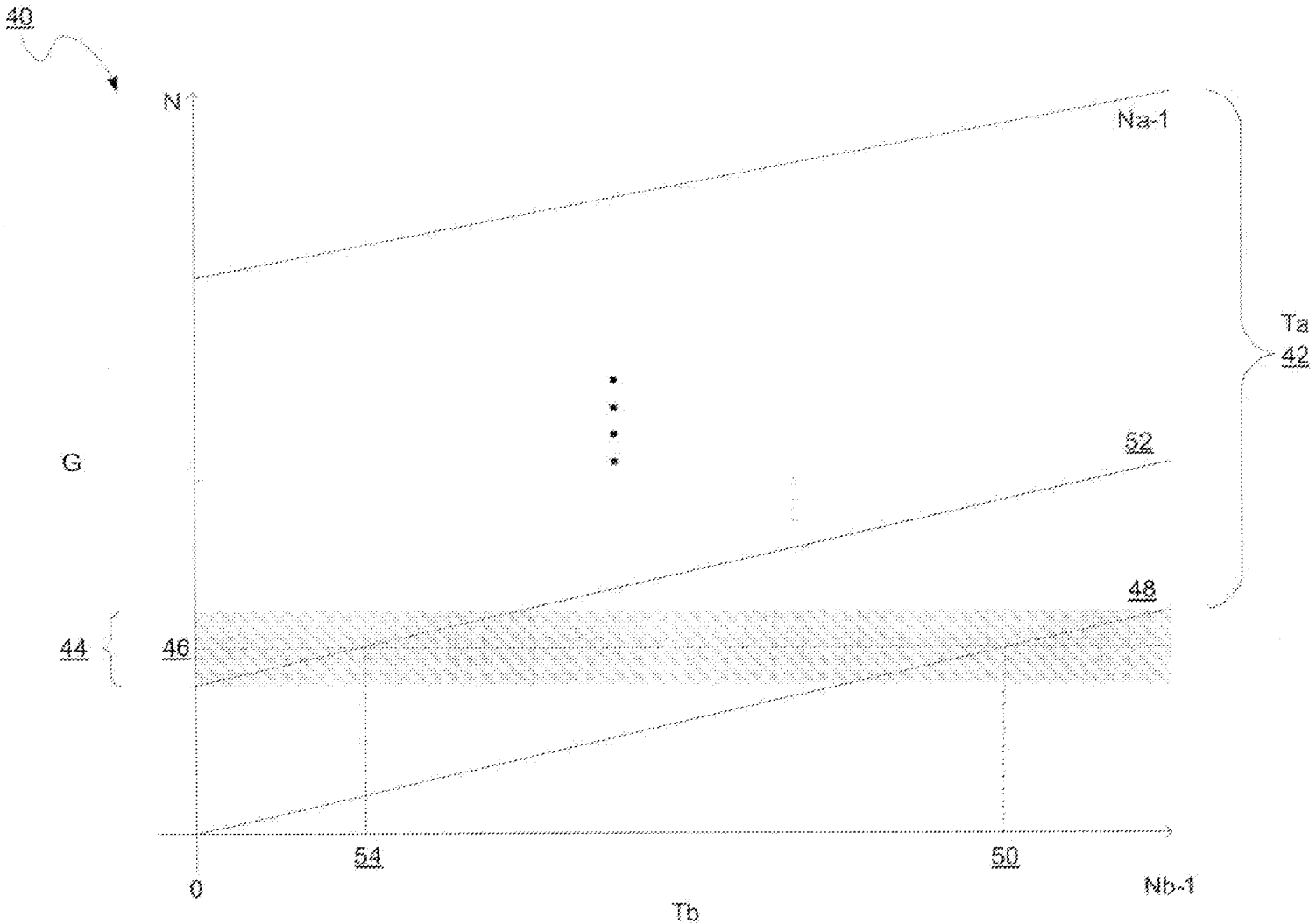
FIG. 3 shows a luminance level graph.

To illustrate, FIG. 3 shows a graph 40 corresponding to the luminance levels of the HDR display. Each curve 42 represents the possible luminance levels as a function of the transmission levels of the second panel Tb(j), 0≦j≦Nb−1, for a given transmission level of the first panel Ta(i), 0≦i≦Na−1. Although each curve 42 is depicted as having a continuous linear variation as j varies from 0 to Nb−1, it will be understood that in practice each value of j will have a specific luminance level G, and there will also be some incremental and abrupt change in the luminance level G as the transmission level of the second panel Tb(j) is changed from a particular value of j to j+1. Thus, each curve 42 in actual practice would have more of a stair-step appearance with each luminance level G corresponding to the specific transmission level of the second panel Tb(j). Furthermore, for a given transmission level of the first panel Ta(i), the incremental difference in the luminance level G will typically vary with changes in the transmission level of the second panel Tb(j). For example, each curve 42 in may exhibit a more exponential rate of increase with increasing values of j.

Luminance range 44 includes luminance levels that can be rendered by driving multiple combinations of transmission levels of the first panel with transmission levels of the second panel. As an example, a given luminance level 46 can be rendered by driving a first combination of a transmission level of the first panel 48 with a transmission level of the second panel 50. Alternatively, luminance level 46 can be rendered by driving a second combination of a transmission level of the first panel 52 with a transmission level of the second panel 54. Process 20 (FIG. 2) can then designate either the first or second combination to render luminance level 46 while deleting the other combination. In some implementations, different luminance levels within a relatively narrow luminance range 44 can be considered equal for purposes of deleting one or more particular combinations of transmission levels of the first and second panels 12 and 14 (e.g., where the luminance levels are so close that they are not distinguishable by a human eye). In other implementations, even very minor differences between luminance levels generated by different combinations can be maintained so as to enable as many different luminance levels as possible.

Referring back to FIG. 2, generally, process 20 arbitrarily designates (28) an entry, but any designation scheme can be implemented. For example, given multiple entries with equal values, process 20 can designate (28) the entry that maximizes the transmission level of the first, or alternatively, the second panel. Alternatively, process 20 can designate (28) the entry that allows the HDR display to be rendered with minimal change in the transmission levels between the first and second panels. Other designation schemes can also be used. These approaches can help facilitate a smooth transition in changes to the luminance levels of the HDR display.

After process 20 designates (28) one of the entries and deletes (30) the others, process 20 reindexes (32) the table from 0 through M, where $0 \leqq M < N$. M is the number of rows in the table. This table can be stored, for example, in the luminance level database 19 (see FIG. 1). The HDR display can then render (34) M possible luminance levels by driving the first and second panels with the combinations of transmission levels Ta(i) and Tb(j) in the table. If the desired luminance level is not found in the table, then the display is rendered (34) to the closest luminance level. In some implementations, the driver 18 can compute the entries of the table, reorder the entries in the table, select one entry from among multiple entries with equal levels, delete other entries from the multiple entries with equal levels, and drive the first and second panels 12 and 14 to render desired luminance levels selected from the M possible luminance levels.

The resulting table is composed thus from a pair of two tables (one for each panel), related to each other, and driven in parallel by the input signal. In this way, the two tables can be used to perform any tone mapping correction to the HDR structure, including gamma correction, linearization, etc. If the response function of the HDR structure is recorded as a correspondence between the M input values and the M possible luminance levels, the tone correction is derived by inverting the transfer function of the display relative to the target tone mapping function desired for the HDR structure. Any desired target tone mapping function, or output target function (e.g., gamma 2.2, gamma 1.8, or linear), can be used. The result of the inversion process is recorded as the pair of look up tables that drives the two panels in the HDR structure.

The functional operations described in this specification can be implemented in digital electronic circuitry, or in computer software, firmware, or hardware, including the structural means disclosed in this specification and structural equivalents thereof, or in combinations of them. The invention can be implemented as one or more computer program products, i.e., one or more computer programs tangibly embodied in an information carrier, e.g., in a machine readable storage device. A computer program (also known as a program, software, software application, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub programs, or portions of code). A computer program can be deployed to be executed on one computer or on multiple computers at one site or distributed across multiple sites and interconnected by a communication network.

The processes and logic flows described in this specification, including the method steps of the invention, can be performed by one or more programmable processors executing one or more computer programs to perform functions of the invention by operating on input data and generating output. The processes and logic flows can also be performed by, and apparatus of the invention can be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, the processor will receive instructions and data from a read only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. Information carriers suitable for embodying computer program instructions and data include all forms of non volatile memory, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

Other implementations are within the scope of the following claims.

What is claimed is:

1. A computer-implemented method comprising:

generating, by operation of a computer, entries of a table of luminance levels of a high dynamic range display, wherein the high dynamic range display includes a plurality of panels, with each panel having independently adjustable transmission levels, and each luminance level in the table corresponds to a particular combination of transmission levels for the panels of the high dynamic range display; and ordering, by operation of a computer, the table according to the luminance levels, wherein the table includes multiple entries with substantially equal values for a luminance level;

designating one of the multiple entries to correspond to the luminance level according to a set of predetermined criteria; and storing the table in a computer-readable storage medium for use in controlling a high dynamic range display.

2. The method of claim 1 wherein after designating one of the multiple entries, the method further comprises:

deleting the other multiple entries.

3. The method of claim 1 wherein the method further comprises:

indexing the table monotonically according to an index 0 to M, wherein M is a number of rows of entries in the table and corresponds to M possible luminance levels of the display.

4. The method of claim 1 wherein:

the display includes first and second panels;

the first panel has Na possible transmission levels; and the second panel has Nb possible transmission levels.

5. The method of claim 4 wherein generating the entries of the table comprises:

measuring the luminance level of the display resulting from each combination of the transmission levels.

6. The method of claim 4 wherein generating the entries of the table comprises:

computing the luminance level of the display from each combination of the transmission levels;

wherein computing comprises using a luminance transfer function.

7. The method of claim 6 wherein the luminance transfer function is $G(i,j)=Y(0)*Ta(i)*Tb(j)*C$, wherein:

Y(0) is a luminance level of a backlight of the display;

C is a constant; and

G(i,j) is the luminance level corresponding to transmission levels Ta and Tb of the first and second panels, respectively, wherein:

Ta is denoted from Ta(0) to Ta(Na−1) and indexed Ta(i), wherein $0 \leqq i \leqq Na-1$; and Tb is denoted from Tb(0) to Tb(Nb−1) and indexed T(j), wherein $0 \leqq j \leqq Nb-1$.

8. The method of claim 1 further comprising rendering the display to a luminance level according to a corresponding entry in the table.

9. The method of claim 1 further comprising generating a tone mapping correction between the ordered table and an output target function for the high dynamic range display.

10. The method of claim 9 wherein the tone mapping correction comprises gamma correction.

11. A computer program product, tangibly stored on a non-transitory computer-readable storage medium, to drive a high dynamic range display, comprising instructions operable to cause a programmable processor to:

generate entries of a table of luminance levels of a high dynamic range display, wherein the high dynamic range display includes a plurality of panels, with each panel having independently adjustable transmission levels, and each luminance level in the table corresponds to a particular combination of transmission levels for the panels of the high dynamic range display; and order the table according to the luminance levels, wherein the table includes multiple entries with substantially equal values for a luminance level;

designate one of the multiple entries to correspond to the luminance level according to a set of predetermined criteria; and store the table in a computer-readable storage medium for use in controlling a high dynamic range display.

12. The computer program product of claim 11 wherein after designating one of the multiple entries, the computer program product further comprises instructions operable to cause a programmable processor to:

delete the other multiple entries.

13. The computer program product of claim 11 further comprising instructions operable to cause a programmable processor to:

index the table monotonically according to an index 0 to M, wherein M is a number of rows of entries in the table and corresponds to M possible luminance levels of the display.

14. The computer program product of claim 11 wherein:

the display includes first and second panels;

the first panel has Na possible transmission levels; and the second panel has Nb possible transmission levels.

15. The computer program product of claim 14 wherein generating the entries of the table comprises:

measuring the luminance level of the display resulting from each combination of the transmission levels.

16. The computer program product of claim 14 wherein generating the entries of the table comprises:

computing the luminance level of the display from each combination of the transmission levels;

wherein computing comprises using a luminance transfer function.

17. The computer program product of claim 16 wherein the luminance transfer function is $G(i,j)=Y(0)*Ta(i)*Tb(j)*C$, wherein:

Y(0) is a luminance level of a backlight of the display;

C is a constant; and

G(i,j) is the luminance level corresponding to transmission levels Ta and Tb of the first and second panels, respectively, wherein:

Ta is denoted from Ta(0) to Ta(Na−1) and indexed Ta(i), wherein $0 \leqq i \leqq Na-1$; and Tb is denoted from Tb(0) to Tb(Nb−1) and indexed T(j), wherein $0 \leqq j \leqq Nb-1$.

18. The computer program product of claim 11 further comprising instructions operable to cause a programmable processor to:

render the display to a luminance level according to a corresponding entry in the table.

19. The computer program product of claim 11 further comprising instructions operable to cause a programmable processor to map the ordered table to an output target function.

20. A display comprising:

a light source;

first and second panels arranged such that light from the light source passes through the first and second panels in series, wherein:

the first panel includes Na possible transmission levels for a first color channel; and the second panel includes Nb possible transmission levels for the first color channel;

a driver coupled to the first and second panels to drive the first and second panels to respective transmission levels according to entries of a table of luminance levels, with each entry in the table corresponding to a combination of respective transmission levels for the first and second panels, wherein a plurality of different possible combinations of transmission levels for the first and second panels produce luminance values that are substantially equal for the first color channel, and wherein, for the plurality of different possible combinations of transmission levels that produce luminance values that are substantially equal, the table of luminance values includes one combination of the plurality of different possible combinations of transmission levels for the first and second panels that is designated for the driver to use to produce the substantially equal luminance value for the first color channel.

21. The display of claim 20, wherein values of the transmission levels are stored as retrievable entries in a table on one or more machine-readable media.

22. The display of claim 20, wherein the driver comprises a luminance transfer function.

23. The display of claim 22, wherein the luminance transfer function is mapped to a gamma correction function.

24. The display of claim 22, wherein the luminance transfer function is $G(i,j)=Y(0)*Ta(i)*Tb(j)*C$, wherein:

$Y(0)$ is a luminance level of a backlight of the display;

$C$ is a constant; and $G(i,j)$ is the luminance level corresponding to transmission levels Ta and Tb of the first and second panels, respectively, wherein:

Ta is denoted from $Ta(0)$ to $Ta(Na-1)$ and indexed $Ta(i)$, wherein $0 \leqq i \leqq Na-1$; and Tb is denoted from $Tb(0)$ to $Tb(Nb-1)$ and indexed $T(j)$, wherein $0 \leqq j \leqq Nb-1$.

25. A system comprising:

means for controlling a transmissivity level for each pixel location of a plurality of pixel locations on two or more display panels, with each display panel operable to realize a transmissivity level for each pixel location independently of a corresponding pixel location on the other display panel(s), wherein a set of corresponding pixel locations on the two or more display panels are operable to produce a combined luminance level for a pixel; and means for storing a table of luminance level entries, each luminance level entry identifying a particular transmissivity level for each of the two or more display panels usable to produce a particular luminance for a particular color, wherein at least a portion of the luminance level entries are substantially equal to at least one other combination of transmissivity levels for the two or more display panels capable of producing the particular color at the same combined luminance level.

26. The system of claim 25 further comprising means for generating the table of luminance levels entries.

27. The system of claim 26 further comprising:

means for ordering the table by the luminance levels; and means for designating one of multiple entries to correspond to a specific luminance level in cases where the table includes multiple entries with equal values for the specific luminance level.

* * * * *

UNITED STATES PATENT AND TRADEMARK OFFICE

CERTIFICATE OF CORRECTION

PATENT NO. : 7,821,474 B2
APPLICATION NO. : 11/549544
DATED : October 26, 2010
INVENTOR(S) : Gabriel G. Marcu et al.

It is certified that error appears in the above-identified patent and that said Letters Patent is hereby corrected as shown below:

In column 3, line 60, delete " $0<i<Na-1.$ " and insert -- $0 \leq i \leq Na-1.$ --, therefor.

In column 3, line 63, delete " $0<j<Nb-1.$ " and insert -- $0 \leq j \leq Nb-1.$ --, therefor.

In column 3, line 43, delete " Ta(i) and T(j) " and insert -- Ta(i) and Tb(j) --, therefor.

Signed and Sealed this
Fifteenth Day of November, 2011

David J. Kappos

David J. Kappos
*Director of the United States Patent and Trademark Office*